US007267176B2

(12) United States Patent
Madden

(10) Patent No.: US 7,267,176 B2
(45) Date of Patent: Sep. 11, 2007

(54) DOWNHOLE RESETTABLE JAR TOOL WITH AXIAL PASSAGEWAY AND MULTIPLE BIASING MEANS

(76) Inventor: Raymond Dale Madden, Madden Systems. Inc., Odessa, TX (US) 79761

( * ) Notice: Subject to any disclaimer, the term of this patent is extended or adjusted under 35 U.S.C. 154(b) by 0 days.

(21) Appl. No.: 10/757,254

(22) Filed: Jan. 13, 2004

(65) Prior Publication Data

US 2005/0150693 A1 Jul. 14, 2005

Related U.S. Application Data

(60) Provisional application No. 60/439,955, filed on Jan. 13, 2003.

(51) Int. Cl.
*E21B 31/107* (2006.01)

(52) U.S. Cl. ..... 166/301; 166/178; 175/293; 173/202

(58) Field of Classification Search ..... 175/293, 175/299, 300, 302, 304; 166/178, 301; 173/115, 173/202; 294/86.23
See application file for complete search history.

(56) References Cited

U.S. PATENT DOCUMENTS

| | | | | |
|---|---|---|---|---|
| 2,144,869 | A * | 1/1939 | Boulter | 175/299 |
| 2,706,616 | A | 4/1955 | Osmun | |
| 2,739,654 | A | 3/1956 | Kinley et al. | |
| 4,508,174 | A | 4/1985 | Skinner et al. | |
| 4,646,830 | A | 3/1987 | Templeton | |
| 4,736,797 | A | 4/1988 | Restarick, Jr. et al. | |
| 4,844,157 | A * | 7/1989 | Taylor | 166/178 |
| 4,846,273 | A * | 7/1989 | Anderson et al. | 166/178 |
| 4,919,219 | A * | 4/1990 | Taylor | 175/299 |
| 4,921,438 | A | 5/1990 | Godfrey et al. | |
| 5,069,282 | A * | 12/1991 | Taylor | 166/301 |
| 6,481,495 | B1 * | 11/2002 | Evans | 166/65.1 |
| 6,502,638 | B1 * | 1/2003 | Stoesz | 166/301 |
| 2002/0104380 | A1 | 8/2002 | Brewer | |
| 2002/0112866 | A1 | 8/2002 | Buyers et al. | |
| 2004/0188085 | A1 * | 9/2004 | Tillett, Jr. | 166/178 |
| 2005/0092494 | A1 * | 5/2005 | McElroy et al. | 166/301 |
| 2005/0092495 | A1 * | 5/2005 | Evans | 166/301 |

* cited by examiner

*Primary Examiner*—David Bagnell
*Assistant Examiner*—Daniel P Stephenson
(74) *Attorney, Agent, or Firm*—Marcus L. Bates

(57) ABSTRACT

A wireline jar tool delivers instrument packages into wellbores and retrieves tools when they get stuck. The jar has several stored spring chambers connected to accelerate an upper spring chamber away from a stuck lower carrier chamber that supports instrument packages. Wireline tension actuates the jarring action and then lowers a sinker bar for reset as many times as required to incrementally jar the un-stick fish uphole. The wire line connects to a conductor that extends inside the tool through a main operating shaft, release coupling, hammer and anvil, lost motion coupling, into the lower chamber where the end connects to the instruments for communication to the surface. A small wireline tension provides unexpected large impact forces.

8 Claims, 9 Drawing Sheets

20
17
13
18
112
11
16
215
17
12
14
13
10
17
19
22
P1
F1
16
15
31
24
26
14
26
12
12
14
12'
14'
118
F2
P2

17
19
21
22
22'
22"
14
30
49
70
16
68
71
249
31
24
26

143
132
60
63
32
34
32'
161
356
59'
160
349
260
59
261
16
61
149'
62
149
149'
64
162
265
65
166
165
166
66'
343
66
168'
70
168
68
32
34

168
68
71

69
32
174
78
73
76
72
16
74
75
77
249
81
34
33
80

DOWNHOLE RESETTABLE JAR TOOL WITH AXIAL PASSAGEWAY AND MULTIPLE BIASING MEANS

CROSS-REFERENCE TO RELATED APPLICATIONS

Provisional Patent Application Ser. No. 60/439,955 Filed: Jan. 13, 2003 Entitled: "DOWNHOLE RESETTABLE JAR TOOL WITH AXIAL PASSAGEWAY AND MULTIPLE BIASING MEANS" For Inventor: RAYMOND DALE MADDEN ODESSA, TEXAS 79761

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

A novel resettable jar tool for use downhole in a borehole for enhancing the retrieval of stuck objects. The stuck object may be part of a tool string that includes the jar tool of this invention. The jar tool can withstand high temperature and other deleterious downhole conditions without significantly reducing the magnitude of the stored energy employed for actuating the jar tool.

The jar tool is resettable as many times as required to dislodge a stuck object by manipulating the operating wireline that allows electronic communication between apparatus connected to the bottom of the tool and the surface by an electrical conductor that extends through the entire jar tool. The jar includes a hammer, anvil and releasable latch device cooperatively interconnected to increase the safety of the tool and to deliver a powerful uphole thrust responsive to wireline tension.

BRIEF SUMMARY OF THE INVENTION

In the art of producing fluid from a borehole, sometime a borehole is drilled fairly straight, sometime it is crooked, or is deliberately slanted. Most boreholes are crooked, thereby tremendously increasing the probability of a string of tools becoming stuck downhole in a borehole. This invention is directed to a wireline actuated jar tool for use in retrieving a stuck downhole tool from a borehole. Hence, it is apparent that the stuck tool string must somehow be unstuck without resorting to placing undue tension on the supporting wireline.

A parted wireline is considered a catastrophe in the oil patch for a costly fishing job is then necessary, and such a delay will be disastrous for any delicate instrument package left downhole long enough to be fried by the bottom hole temperatures. The jar tool of this invention overcomes the necessity of ever applying excessive tension in the wireline that supports the tool string. This is achieved in accordance with the present invention by a resettable, stored energy jar tool system capable of multiplying the tension of the E-line as much as ten fold, as will be more fully appreciated as this disclosure is further digested.

The preferred embodiment of the jar tool of this invention discloses a downhole tool string which includes the downhole jar tool. The jar tool includes an upper member opposed to a lower member with the two members being coupled together by means of a lost motion coupling in a manner to provide axial slidable movement therebetween, whereby the opposed members provide opposed masses that are selectively moved towards and away from one another a distance determined by the lost motion coupling which is attached therebetween.

The lower member of the jar tool is attached to most any desired downhole tool, apparatus, or device, including an instrument package, for example, that might also be insulated from the high temperature formations, while the upper jar tool member is provided with a unique plurality of spaced stored energy chambers therein, whereby a plurality of forces are advantageously added together and made available for creating a powerful upthrust when one member is released from the other and is accelerated responsive the magnitude of the stored energy.

Means are provided for releasing the energy of said stored energy chambers upon demand to effect rapidly accelerating movement of one member respective the other member and thereby propel one said member away from the other member. At a selected length of stroke, an internal part of the tool acts as a hammer with the hammer being positioned to strike another internal part of the tool which acts as an anvil, thereby providing sudden deceleration of a magnitude and direction to accelerate the entire tool string uphole with sufficient thrust to un-stick the tool string when it is stuck down-hole. This action incrementally drives the entire downhole tool string in an uphole direction with a thrust which un-sticks the stuck tool string.

An outstanding feature of this invention is the provision of a longitudinally extending passageway disposed along the central axis of the jar tool and extends from the up-hole tool end, through each of the jar tool members, including the lost motion coupling, where the passageway terminates within the lowermost member of the jar tool and thereby allows for the employment of an insulated conductor within the passageway that continues through the remainder of the jar tool to an instrument package therebelow enabling transmission of important data along the conductor from and to the surface of the earth. Provision is made to eliminate problems associated with change in length of the insulated conductor as the jar tool components are extended in length and then retracted as the jar tool moves from the extended configuration following a jarring action into the retracted standby configuration.

Furthermore, safe protection of the insulated conductor that extends through the jar tool is provided by a through tubing positioned within the recited axial passageway which encloses the insulated conductor so that the conductor is protected, whereby one terminal end of the insulated conductor ultimately is placed into electrical communication with the downhole instrument package, for example, or other tool package, with the opposed terminal end of the conductor being electrically connected to the wireline or other means for data transmission uphole to a surface receiver. Accordingly, the downhole instrument can conduct or electronically transfer various vital information between the instrument package, through the axial conductor within the jar tool, and finally to an above ground facility.

Some instrument packages are extremely valuable, and contain confidential information and design secrets which must be protected from damage as well as from evil plagiarists. Therefore, it is essential that in such a situation, the electronic package must not remain downhole for extended lengths of time because the apparatus must be kept out of harms way. The present invention provides a unique safe guard for such valuable apparatus.

This disclosure further provides means for resetting the jar tool a multiplicity of times to thereby again store energy within spaced energy storing chambers thereof so that the jar tool of this invention can provide a multiplicity of sequential jarring actions that sooner or later result of the jar tool being translocated axially away from the stuck location, dragging along any attached apparatus therewith.

Another outstanding feature of this invention is the provision of a jar tool having multiple sources of energy available to strike the recited anvil with a powerful blow of the hammer, which jointly provide unexpected improvements in jar tools. These forces are realized by the joint action of the E-line tension, and the force derived from the multiplicity of energy storage devices. Further, adjustment means related to the magnitude and timing of the effect obtained from the use of the several stored energy devices is taught herein. Variation in the length of stroke of the two interconnected coacting jar tool parts, the cumulative force available from the stored energy chambers, and the tension required in the E-line to trigger the hammer blow is considered to be within the comprehension of this invention. Equally important is the novel concept and method of extending an electrical conductor through the axis of the jar tool, as well as the unique safety features presented and claimed herein. Other objects and advantages of this invention will be evident from the following description.

Accordingly, a primary object of this invention is the provision of a down-hole jar tool for use in a bore-hole for enhancing the retrieval of stuck objects. The stuck object may be part of a tool string that includes the jar tool. The jar tool is made of suitable alloys which can withstand high temperature and other deleterious down-hole conditions without significantly or unduly reducing the operating efficiency of the jar tool.

Another object of this invention is the provision of a preferred embodiment of the jar tool, having an upper member and a lower member coupled together by a lost motion coupling in the form of opposed members arranged for limited axially slidable movement thereof, whereby the opposed members provide opposed masses that are selectively moved towards and away from one another as determined by the characteristics of the lost motion coupling located therebetween; thereby providing means by which a hammer and an anvil of the jar tool are manipulated to impact one said member against the other member with sufficient force which results in uphole thrust of the members. This action drives the entire downhole tool string in an uphole direction with a powerful upthrust which invariably un-sticks the stuck tool.

A further object of this invention is provision of the above downhole jar tool wherein one said member thereof can be attached within most any desired downhole tool string, including an instrument package, for example, that often will be insulated from high temperature formations while the other said member of the jar tool is provided with a unique plurality of spaced stored energy chambers therein whereby a plurality of forces are advantageously added together and made available for creating upthrust when one impacts against the other, thereby unsticking a stuck downhole tool or tool string in a new and unobvious manner.

A still further object of this invention is the above recited jar tool wherein means are provided for releasing the energy of said stored energy chambers upon demand to effect rapid accelerating movement of one jar tool member respective the other jar tool member and thereby propel one said member away from the other said member in a manner to move both members uphole. At a selected length of stroke, a part of the tool acts as a hammer positioned to strike a part of the tool which acts as an anvil, and thereby provides sudden deceleration having an impact of a magnitude to accelerate the entire tool string uphole with sufficient thrust to un-stick the tool when the tool is stuck down-hole.

Another and still further object of the invention is a jar tool having the provision of a central passageway that lays along the longitudinal central axis of the tool extending from the up-hole tool end to the lowermost tool end and thereby allows for safe protection of an insulated conductor to be placed into communication with a downhole instrument or other package, whereby the downhole instrumentation can conduct and transfer electronically various vital information between the instrument package and an above ground facility.

An additional object of the invention is the provision of means for resetting the tool set forth in the above objects, by manipulation of the wireline tension to thereby again store energy within the spaced energy storing chambers so that the jar tool of this invention can provide a multiplicity of sequential jarring actions.

Still another and further object of this invention is the provision of adjustment means related to the magnitude and timing of the stored energy devices. In particular, the length of stroke of the two coacting tool parts, the force available from selected stored energy chambers, and the tension required in the E-line to trigger the hammer blow is considered to be within the comprehension of this invention.

These and other objects and advantages of this invention will become readily apparent to those skilled in the art upon digesting the following detailed description and claims and by referring to the accompanying drawings.

The above objects are attained in accordance with the present invention by provision of a combination of elements which are fabricated in a manner substantially as described herein.

DETAILED DESCRIPTION OF THE INVENTION

Figure 1:
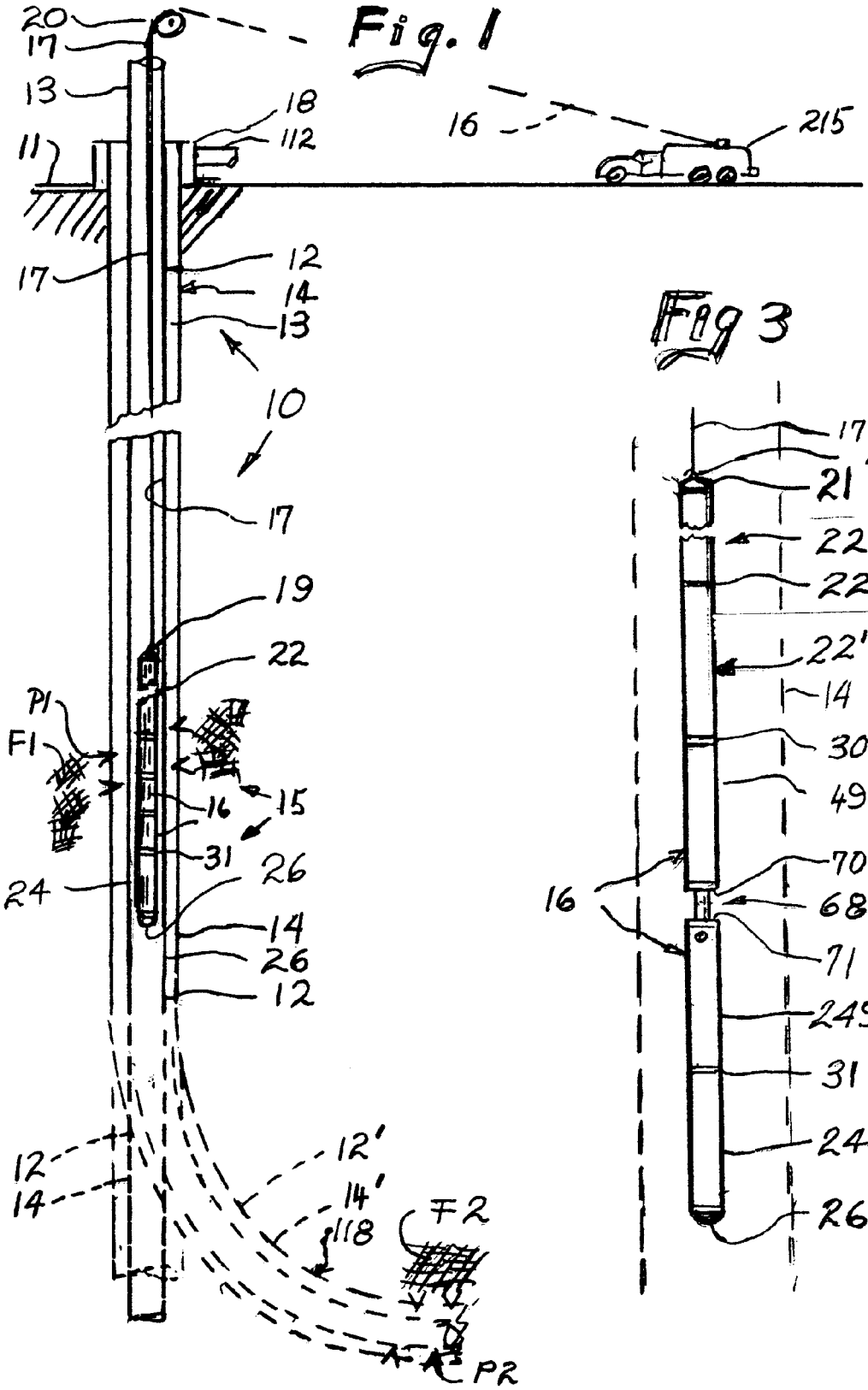
FIG. 1 is a part schematical, part diagrammatical, part cross-sectional representation of a wellbore that produces fluid from a fluid producing strata and discloses the present invention associated therewith in the standby configuration ready to jar.
Figures 2, 2A, 2B, 2C, 2D, 2E, 2F:
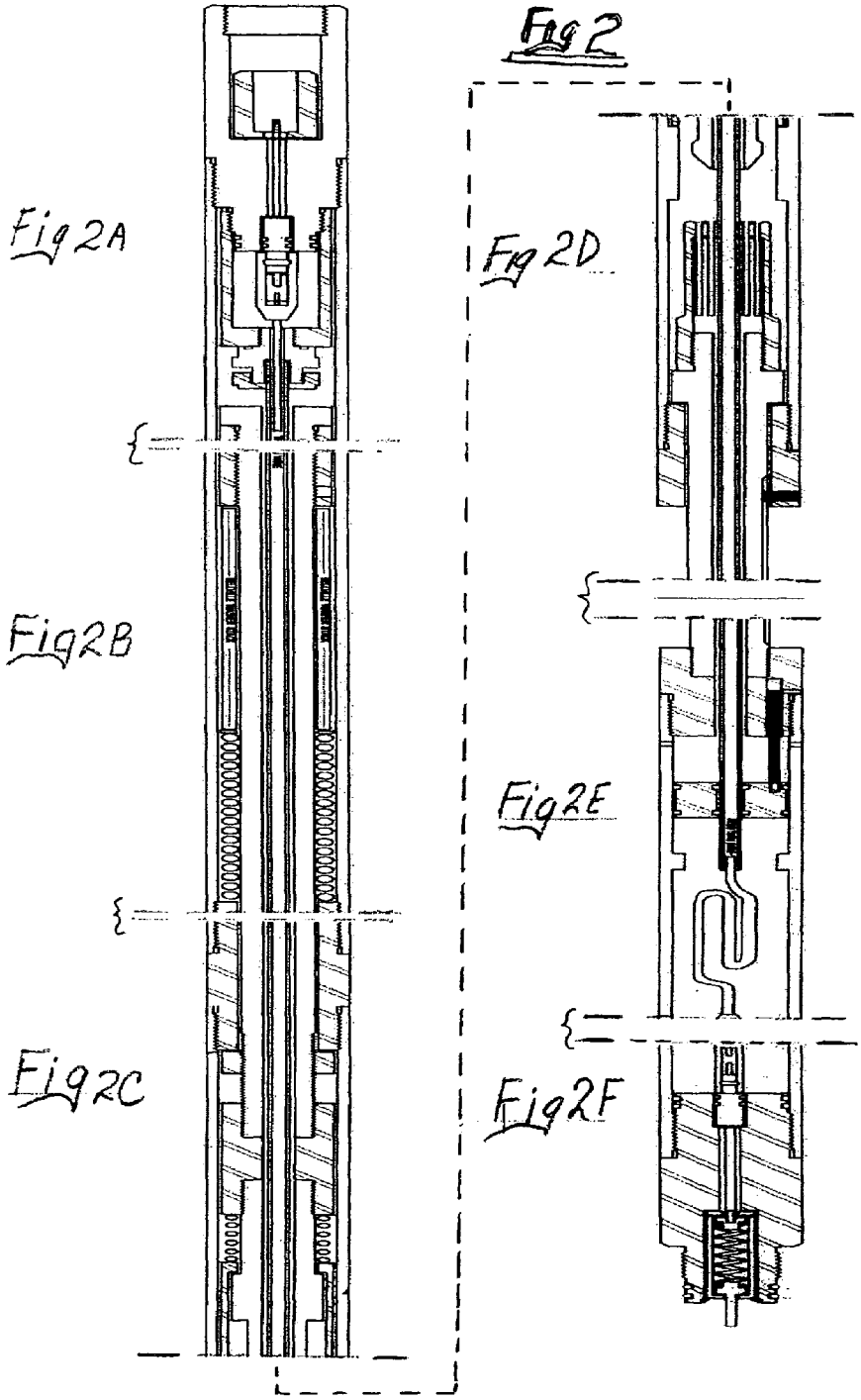
FIG. 2 is an enlarged, broken or composite view of the tool disclosed in FIGS. 1 and 4 illustrating the proper arrangement of the tool of FIGS. 2A, 2B, 2C, 2D, 2E, and 2F.
FIGS. 2A, 2B, 2C, 2D, 2E, and 2F, when taken together, set forth an enlarged, detailed, part schematical, part diagrammatical, part cross sectional representation of the invention disclosed in FIGS. 1, 2, and 3.
Figure 2A:
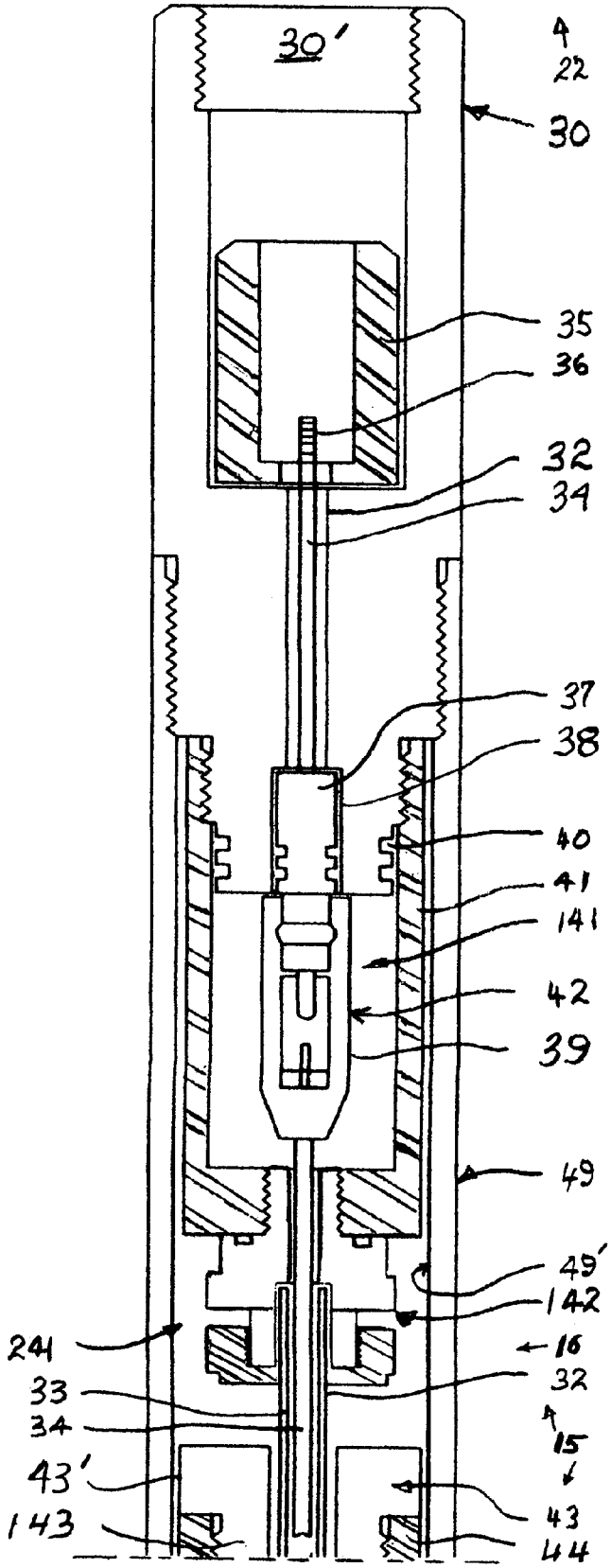
Figure 2B:
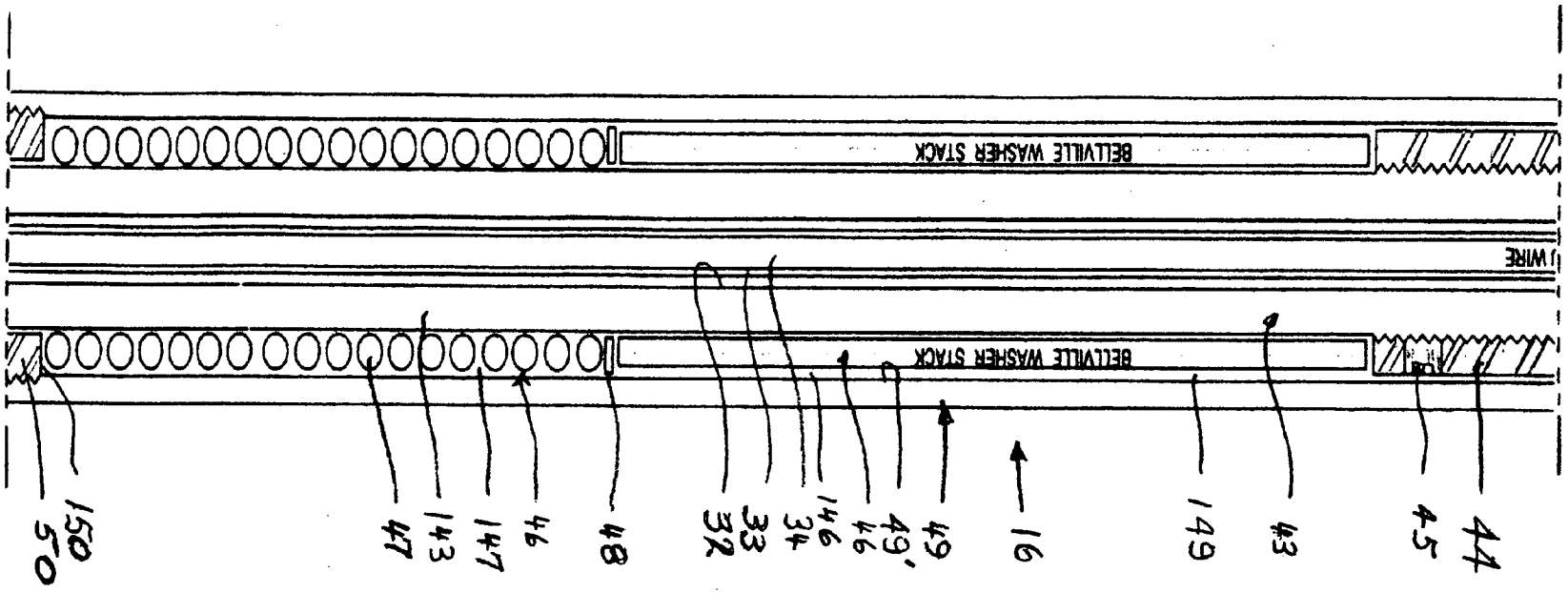
Figure 2C:
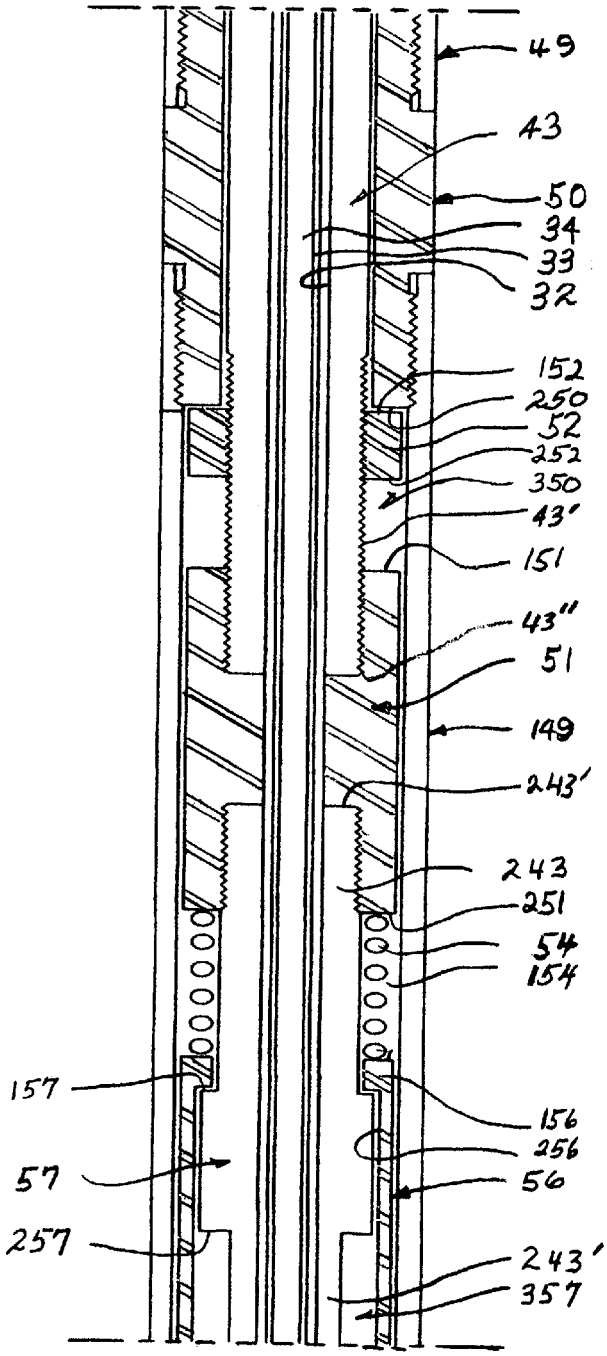
Figure 2D:
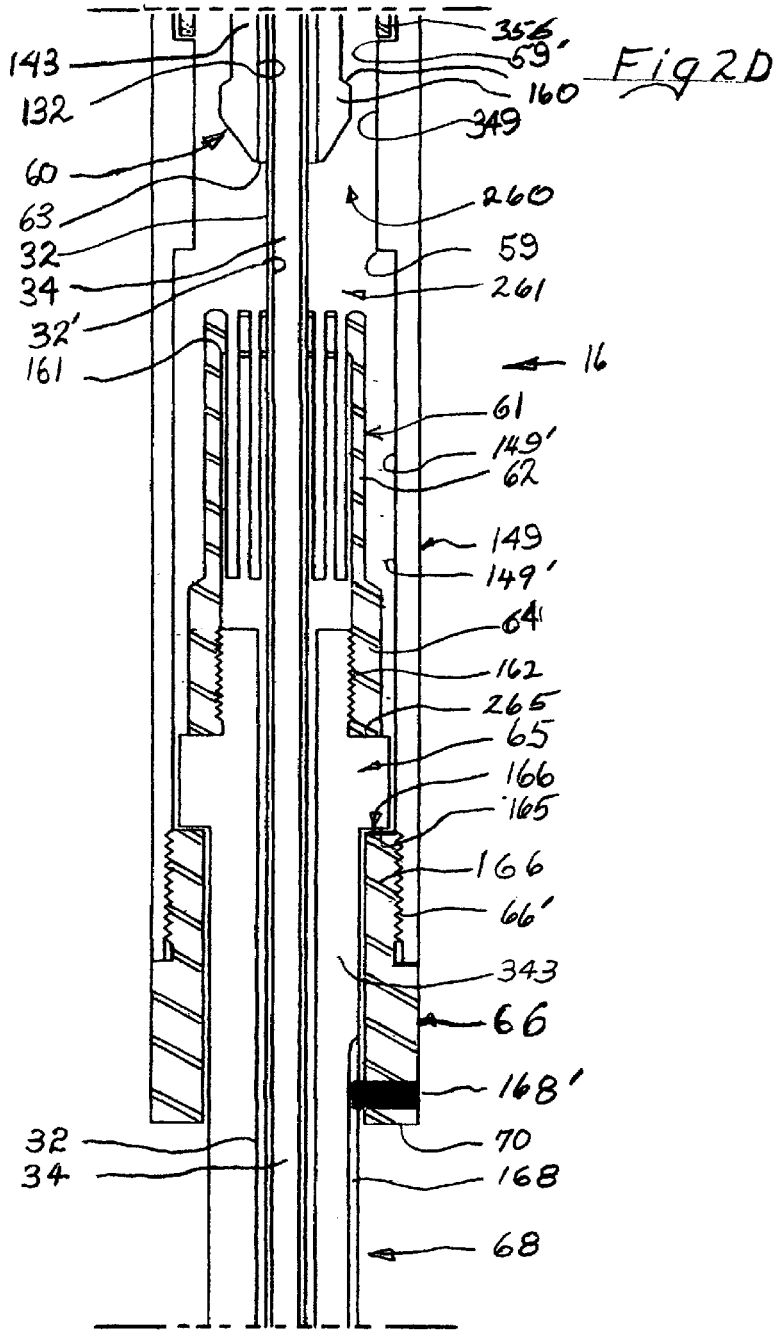
Figure 2E:
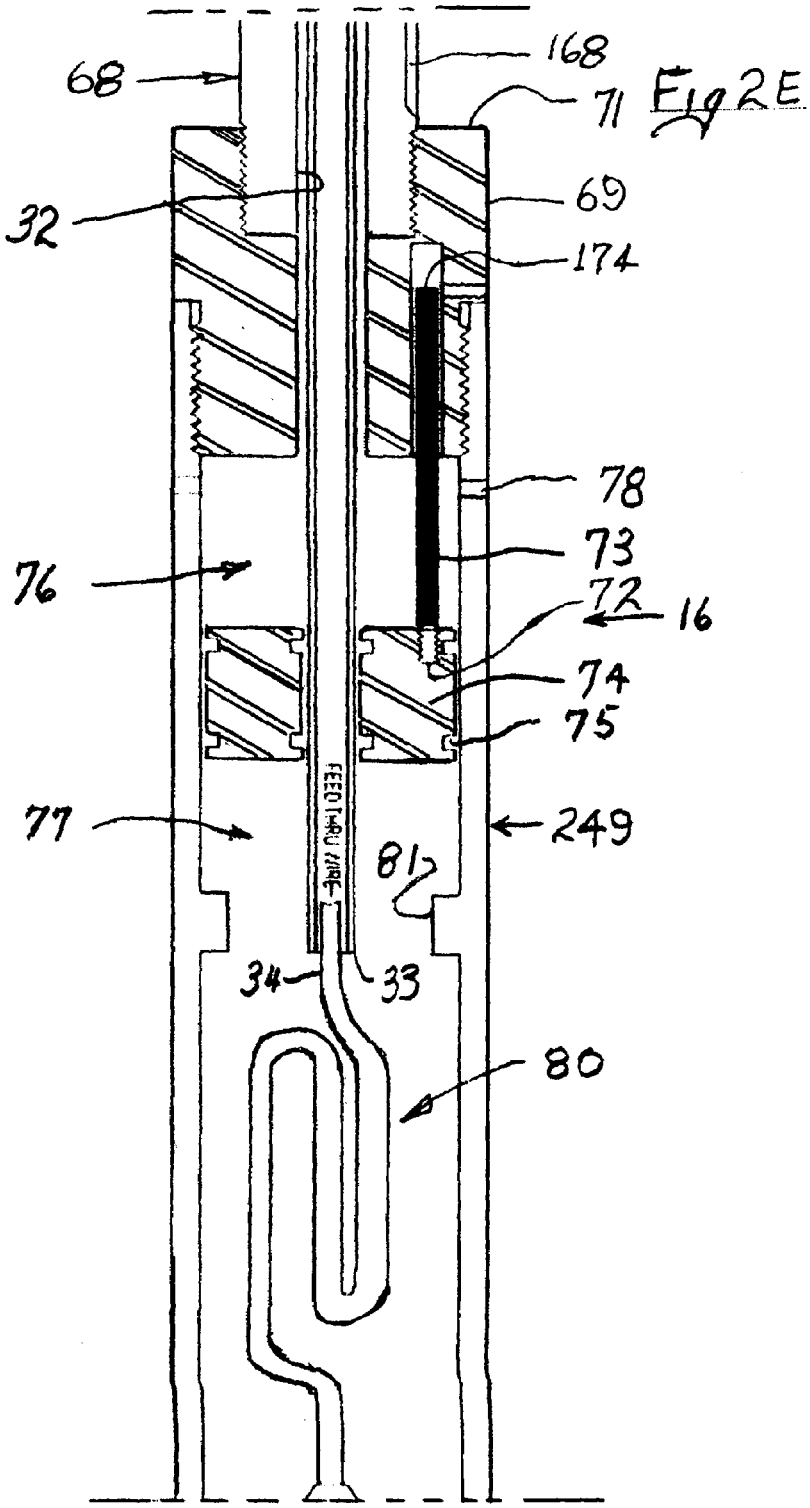
Figure 2F:
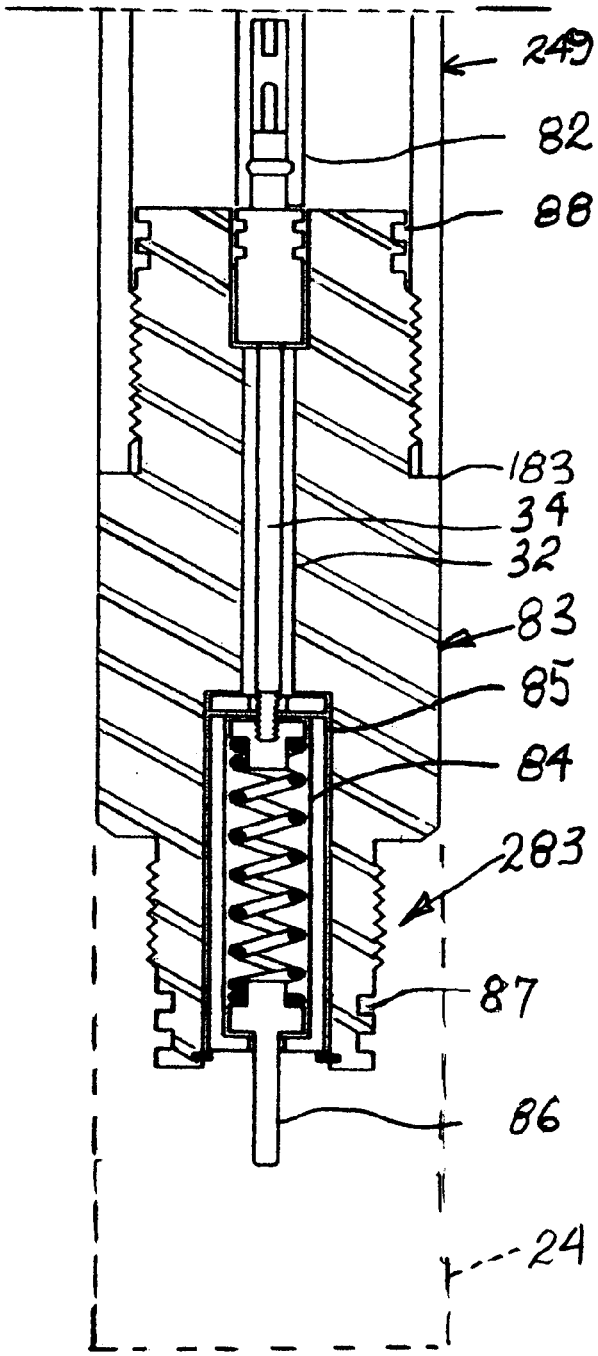

FIGS. 1 and 2 of the drawings disclose an oil well or borehole 10 within which there is supported a tubing string 12 telescopingly received within a casing 14. Casing 14 is located within the formed borehole 10 that extends from wellhead 18 at the surface 11 of the earth, through a formation or payzone F, and continues on downhole at 14, or might instead curve at 14' into another payzone as noted at F2, such as is achieved with directional drilling. Casing 14 is perforated in the usual manner at P or P2.

A wire line tool string 15 has been run into tubing string 12 contained within casing 14 of borehole 10 on an E-line 17, a slick line or wire rope having an electrical conductor therein. Sometime the tool may be run into the borehole on the end of any suitable elongate member, such as a suitable conduit or elongate tendon such as a pipe, a sucker rod string, or most any logical support member suitable for the occasion.

Usually, a wire rope 17 having a suitable insulated electrical conductor therewithin, is used for supporting a tool string 15. A lifting rig 215 can take on any number of different forms and should include a weight indicator connected to determine tension of the wire rope or E-line 17 which is spooled onto a drum 20 with the downhole end of E-line 17 terminating in a rope socket at the up-hole end 21 of a sinker bar 22 of tool string 15. The insulated conductor is electrically connected to continue through a passageway formed in sinker bar 22, through a jar tool 16, made in accordance with the present invention, and to the lowermost apparatus 24 which is supported by the lower end 31 of jar tool 16, thereby providing transfer of electronic data signals downhole and uphole along E-line 17 that supports tool string 15.

Sometime borehole 10 is relatively straight, as seen in FIG. 2. Sometime a borehole is crooked, or is deliberately slanted as illustrated in FIG. 1. Most boreholes are crooked and this increases the probability of a string of tools becoming stuck downhole in the borehole, as seen illustrated in FIG. 1 at 118, for example.

The uphole end of the jar tool 16 as seen in FIG. 2A, preferably terminates in a closure that takes on the form of a sub 30 presenting a box end 30' opposed to the downhole end 31, where various different apparatus, including instrument packages and the like, can be supported. The opposed ends 30, 31 are easily interfaced with other tools by standard subs in a manner that is known in this art.

Figure 3:
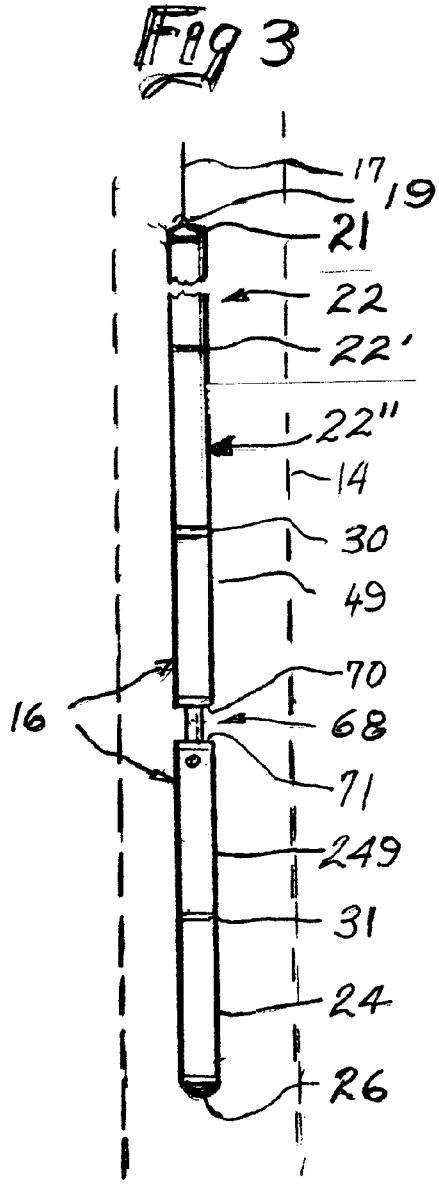
FIG. 3 is a part schematical, part diagrammatical, part cross-sectional, side view showing the assembled tool of this invention in the alternate extended configuration.

FIG. 3 discloses additional details of tool string 15 of FIG. 1, comprising, commencing at the upper end of FIG. 2, a wire line or E-line 17, a rope socket attached at 21, to a sinker bar 22, the jar tool 16 of this invention, and an adaptor sub 31 which terminates in attached relation respective any desired tool or instrument package 24 that reasonably can be supported from the lower end 31 thereof.

Still looking at FIG. 3, sinker bar 22 can be of any desired length, so long as its mass enables resetting jar tool 16 after a jarring action of the jar tool has taken place, thereby enabling multiple sequential jarring actions to be carried out, as will be more fully appreciated later on herein. At the top 30 of jar tool 16 and in underlying relationship respective sinker bar 22, it will be seen that the diagrammatical representation of the jar tool 16 of FIGS. 2 and 3 has been subdivided into the indicated FIGS. 2A through 2F, thereby enabling the details of each of these assembled Figures to be more fully disclosed on six different sheets of drawing, submitted herewith and forming part of this non-provisional patent application. It should be appreciated that an E-line 17 or equivalent, is connected to a conductor extending axially through sinker bar 22 into communication respective the uppermost end 30 of jar tool 16, and thereafter the electrical conductor extends axially through jar tool 16 into electrical contact respective the instrument package 24.

FIG. 2A illustrates the preferred embodiment of the uphole marginal length of jar tool 16 in greater detail. An upwardly opening box end 30 forms the upper end of jar tool 16 and threadedly engages the lower end of the before mentioned sinker bar 22 by using a suitable interfacing sub as may be necessary. An axial passageway 32 extends longitudinally through the entire jar tool 16, as well as through the sinker bar 22. Hence numeral 32 indicates the initial part of the annular passageway formed between connector 35 and the connector 42.

The upper terminal end of a hollow protective tubing 33 is anchored or removably received in close tolerance relationship within connector 142 in order to sealingly accommodate the electrically insulated conductor 34 suitably protected therewithin for providing a source of power to any desired instrument package 24 attached at the lowermost end 31 of jar tool 16 for data transmission from below jar tool 16 uphole to the surface 11, as previously noted.

Cylindrical insulator 35 provides for attachment of the conductor 34 at terminal end 36 of through conductor 34. Connectors 37, 39 are male and female connectors that are telescopingly fitted together and mounted within the enlarged portion 38 of passageway 32 to facilitate assembly of the various threadedly connected tool components of this invention. Seal means (not shown) are suitably seated within the seal grooves 40 and preferably are high temperature o-rings. Chamber 141 formed within the bell shaped member 41 isolates connector 39 therewithin to enable access to connector 39 and to continue through chamber 241 into the next adjacent chamber 51 of FIG. 2C.

In FIG. 2B, axial passageway 32 that accommodates tube 33 continues down through the central axis of jar tool 16 where it is concentrically arranged respective to a larger annular chamber formed between the outside diameter of protective tubing 33 and the inside diameter of the main housing 49.

Main housing 49 includes a marginal length of the hollow main shaft member 43 reciprocatingly received therein. Looking again now to FIG. 2A together with FIG. 2B, the sealed connection device 142 in chamber 141 seals the working chamber or annulus 146 respective the hollow main shaft 43. Any number of different seal devices can be used, this example being for teaching purposes in order to enable full comprehension of the disclosure.

In FIGS. 2B and 2C, conductor 34, tube 33 and axial passageway 32 continue axially through jar tool 16 in order to protect insulated electrical conductor 34 which is coextensive therewith. The illustrated through conductor 34 is protected by suitable insulation which further is protected by the before mentioned through tubing 33.

The before mentioned hollow main shaft member 43 is threadedly engaged by adjustment nut 44 which is locked thereto by adjustable fastener means as indicated by numeral 45. The lower end of adjustment nut 44 abuttingly engages the uphole end of the illustrated annular Bellville washer stack 46 having a strong spring or biasing action. Bellville washer stack 46 terminates with the downhole end thereof abuttingly engaging the uphole end of a powerful, fully compressible spring device 47, with there being a spacer or separator 48, such as a washer, placed therebetween and separating annulus 149 into stored energy chambers 146, 147.

Main housing 49 of FIGS. 2A, 2B, and 2C is seen to be sectioned into multiple lengths to facilitate assembly, and are connected together by means of a sub 50 (FIG. 2C) through which the before mentioned main shaft member 43 (FIGS. 2B and 2C) reciprocatingly extends. Main shaft 43 continues into threaded engagement with respect to an internal shaft connector 51, which also serves as a guide that is slidably received within main housing 149, which is considered a continuation of housing 49.

The tube 33, positioned within axial passageway 32, continues through hollow main shaft member 43 and includes insulated conductor 34 therein, all of which continues through main housing 49, 149 as shown in FIGS. 2A, 2B, 2C and 2D. Note that the upper housing 49, 149 are positioned above the lost motion coupling 68 of FIG. 2D while the lower housing 249 of FIG. 2E is therebelow, as will be more fully discussed later on herein. The housing 49 as seen in FIG. 2C, is connected to housing 149 by means of a sub halving opposed faces 150, 250 through which internal threaded bores are formed for threadedly receiving the before mentioned hollow shaft member 43 into threaded engagement with respect to internal slidable connector 51.

As shown in FIG. 2C, axial passageway 32 continues on through main housing 49, 149, sub 50, internal connector 51, and axially through the lower spring chamber 154 where it is connected to the releasable latch apparatus 56, 57, 156 disclosed in FIG. 2C.

Adjustment nut 52, as best seen in FIG. 2C, threadedly engages the marginal threaded end 43' of the lower end 43" of hollow main shaft part 43, while the lower end thereof also threadedly engages internal connector 51 as noted at 151 in FIG. 2C. Internal main shaft connector 51 threadedly engages the uphole end 243' of releasing member 53' and is a continuation of the before mentioned main shaft part 43. It can be seen that sub 51 is slidably received in a reciprocating manner within the interior of main housing 149.

In FIGS. 2C and 2D, the upper end of power spring 54 abuttingly engages the lower end of sub 51 as noted by numeral 151 in FIG. 2C, and is contained within the illustrated annular spring chamber 55. As seen in FIGS. 2C and 2D, the lower end of spring 54 abuttingly engages the upper enlarged end of sleeve 56, while the opposed circumferentially extending end 356 of sleeve 56 bears against internal shoulder 59 of the main housing. Sleeve 56 can be moved axially within its chamber 154 between spring 54 and shoulder 59 responsive to movement of main shaft 43. The sleeve has a counterbore forming an interior shoulder at 156 which abuttingly engages a complimentary shoulder 157 formed on enlargement 57 of latch member 60 that is formed at the lower end of main shaft 43. Hence, lower terminal end 356 of sleeve 56 abuttingly engages shoulder 59 formed internally at 149 on main housing 49. Enlargement 60, which is part of latch apparatus 60, 61 is a continuation of main shaft 43 and forms the male latch part 143, 156, 57, the skirt 356, and the enlargement 60 at the lower terminal end thereof. Male latch part 60, when forced into the interior of female latch member 61 of the latch device 60, 61, occurs responsive to downhole movement of the main housing which concurrently compresses the before mentioned three spaced biasing or spring members seen in stored energy chambers 149, 147 and 154 when the tool is reset into the standby configuration, ready to deliver a jarring action. At terminal end 63 of enlargement 60 is a passageway 132 that is a continuation of passageway 32 that slidably receives through tube 32 therewithin, remembering that the tube is anchored to the before mentioned seal 142, and thereby enables relative movement between main shaft 43 and the through tube 32 while the tube 32 forms a protective housing for conductor 34. It should be noted at this time that the conductor 34 does not significantly telescope respective to the telescoping tube 32.

As further seen in FIGS. 2D and 2E, releasable latch apparatus 60, 61 includes female member 61 made of a multiplicity of radially arranged, circumferentially extending, longitudinally disposed resilient fingers 62 which enlarge at 64 to threadedly engage elongated lower main shaft member 65 while the lower end of main housing 149 threadedly engages a bottom closure member in the form of a sub 66 (see FIG. 2D). Sub 66 includes guide pin 168' received within a keyway or spline 168 formed on lost motion coupling 68 to maintain closure member or sub 66 of lower housing 249 and sub 66 of upper housing 149 aligned respective to one another as the confronting faces 70, 71 of the spaced jar tool subs 66, 69 are moved towards and away from one another, but always remain spaced apart from one another a slight amount after the tool is scoped together for reset, and assumes the illustrated configuration of FIGS. 2D, 2E following a jarring action and prior to reset. The spaced distance between subs 66, 69 is the measure of one stroke.

In FIGS. 2E and 2F, sub 69 is seen to include a radially formed longitudinal counterbore that forms blind passageway 73 within which a guide member 72 is reciprocatingly received such that upper terminal end 74 thereof is always spaced from the blind end of the counterbore that forms radial passageway 73.

As particularly illustrated in FIG. 2E, one end of guide member 73 is affixed to a pressure differential traveling piston 174. The piston has seal grooves 75 suitably formed thereon, thereby isolating chambers 76, 77 from one another as fluid enters and leaves through the ports 78, thereby isolating chamber 77 from well fluids while subjecting chamber 76, to the hydrostatic head of the well fluids.

Chamber 77 is filled with a non-compressible, non-conducting mineral oil to reduce the likelihood of well fluids contaminating the electronic components of the jar tool.

Accordingly, piston 74 moves in low friction relationship respective the interior of main housing 249 and the exterior surface of through tube 32 through which conductor 34 extends, thereby avoiding contamination of the interior of tube 32.

Conductor 34, as shown in FIG. 2E, is formed into a looped or serpentine configuration as indicated at numeral 80, allowing the feed through wire tube 32 to move along the central axis of the jar tool while always having slack at 80 in order to accommodate undue wire tension during reciprocation of tube 32 within main shaft member 43, noting that tube 32 reciprocates concurrently respective sub 49 seen at the anchor seal at the upper end of the jar tool. Enlargement 81 forms a stop member on the interior of main housing 249 for limiting travel of piston 74 in the unlikely event of leakage of well fluid thereinto.

In FIG. 2F, the lowermost end of conductor 34 is received by electrical connector 82 and continues through lowermost sub 83 that forms the lower terminal end of jar tool 16 and thereby enables jar tool 16 to be connected to any desired apparatus at threaded end 283. As further seen in FIG. 2F, a connector 84 is received within enlarged axial counterbore 85 for conducting current flow at 86 to and from the illustrated instrument package 24. Seals 87 and 88 prevent entry of fluid into the lower end of jar tool 16.

Figure 4:
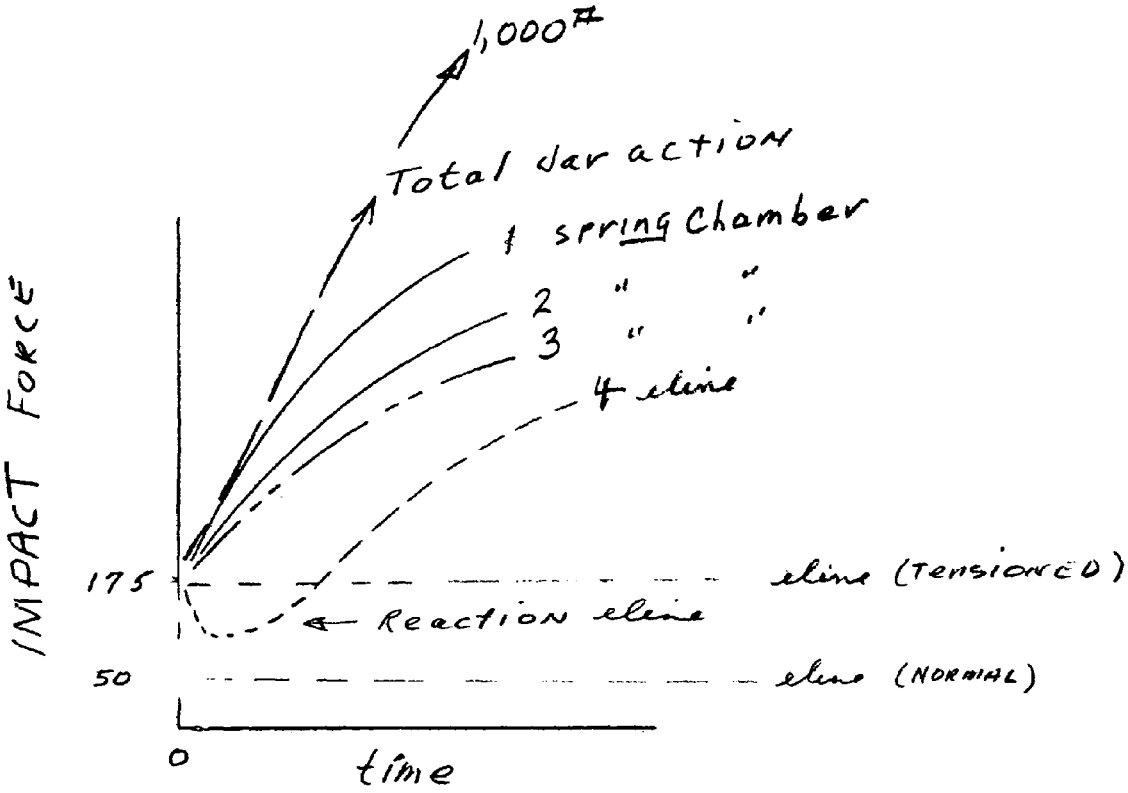
FIG. 4 is a hypothetical plot illustrating the dissipation of the stored energy of the tool of the previous figures of the drawings during impact of a jar action.

FIG. 4 illustrates a hypothetical analyses of the action of jar tool 16 during one jar action. Curve 4 is a plot of he wire line tension commencing with the tool static, hanging free within the in borehole. Curves 1-3 illustrate the upthrust realized from each of the three spring or stored energy chambers. The remaining curve that reaches 1,000 pounds is the sum of curves 1-4.

Characteristics of curves 1-3 can be modified by various changes to the tool as set forth herein, and this, of course, results in a modification of the 1,000 pound curve. In actual practice, it is possible to develop approximately 3,000 pounds upthrust with this embodiment of the invention.

IN OPERATION

In operation, the assembled jar tool 16 is adjusted or set to be actuated at a predetermined fraction of the maximum tensile strength of the E-line. For example, if the E-line breaking strength is 1,000 pounds, the operator may elect to adjust the release tension of the tool latch 61 to be triggered by an uphole force of 200-300 pounds, as read on a weight indicator. This is the force required for the E-line to trigger or pull the male end 60 from the female end 62 of the releasable latch member 60, 61. Resetting the tool for subsequent jar actions requires a downhole force applied to the upper end of the jar tool, similar to the releasing force, depending on the design of releasable latch member 60, 61. Hence, sinker bar 22 must be of a weight greater than the releasing value of latch 61 in order to be on the safe side. Those skilled in the art know to consider the entire weight of the E-line and tool string when viewing the weight indicator at the surface.

Adjusting nut 52 should be set by the shop technician who should make certain that latch means 61 is also adjusted into proper position respective sleeve 56, and reduced diameter passageway at 349, at this time by properly spacing out the component parts of the jar tool. Adjusting nut 44, located immediately adjacent the upper stored energy or spring chamber 146, is rotated or set for minor adjustments in the field. This action gains the desired releasing value of latch assembly 61 and is realized through trial and error while studying the situation using a suitable weight indicator for accuracy.

The adjustments of nut 44 pre-loads the three spring chambers of the upper spaced spring chambers which in turn places a continuous uphole force on male member 60 of releasable latch assembly 60, 61. Accordingly, this action commences a releasing action which is somewhat analogous to the action of the E-line as the release tension force is applied.

The complex action of the jar tool is easily comprehended when it is appreciated that the operating mandrel or main shaft 43 extends from enlargement 43' located at the upper extremity thereof and extends through first spring chamber 146, through second spring chamber 147, through sub 50, adjustment nut 52, and operating chamber 152, where it is joined to the threaded internal connector 51, continues through the third and lowermost spring or energy storage chamber 154, and terminates as the illustrated male part 60 of releasable latch device 61. The main shaft 43 therefore can be forced to slide axially between the limits provided by opposed confronting faces 151, 252 and 250, 152 within chamber 350.

In FIG. 2D, hammer 166 and anvil 165 are illustrated in the impact position.

Male release member 60 together with female latch member 61 are unique in that it cooperates with the third spring chamber 55 in several different manners. Note sleeve 56 is slidably received within the third spring chamber 154 and has an enlargement 156 thereon that abuttingly engages power spring 54 as well as the enlarged diameter part 349 that forms shoulders 59, 59' formed on an inner limited length of main upper housing 149. Also note enlarged member 57 on latch member 60 that is also part of the main shaft 43 and engages member 156 at shoulder 157. Further, sleeve 56 has a downhole end 58 that abuttingly engages shoulder 59 of outermost housing 249. The third spring 54 biases sleeve 56 downhole while abutting internal slidable connector 51 to thereby provide part of the stored energy for contributing to the upthrust of main body 49 together with the other biasing means or stored energy devices of this disclosure. Hence, sleeve 56 is always biased or urged downhole against shoulder 59 by adjacent spring 54 as shown, except when main upper housing 149 moves downhole towards lower main housing 249 during reset. In order for connected or engaged latch assembly 61 to telescope into smaller diameter chamber 260, the latch parts 60, 61 must be fully engaged while they are within the large diameter latch chamber 261, because the latch assembly 61 cannot be reset nor released once it is positioned within small diameter chamber 169, due to the relative diameters of the coacting members.

The latch 60 telescopes into chamber large diameter bore that forms chamber 261 where latch parts 60, 61 have ample room to expand into latched engagement, while they are within the large part 349 of the latch chamber. Hence the latch cannot be set nor released once it is positioned within small diameter bore 349 of chamber 260.

Those skilled in the art having digested this disclosure will appreciate that the lower main housing of the jar tool, when stuck or otherwise held stationary, while the upper box end 30 is forced downward respective thereto, the lost motion coupling 68 telescopes into closure member or sub 66, while the anvil 65 is repositioned further towards the upper tool end as the main housing descends, thus moving the latch means and anvil uphole away from hammer 166 concurrently with the separation of faces 70, 71, respectively, of the confronting subs 66, 69 while at the same time moving enlargement or anvil 65 along with the female latch part 61 into the latched position, which occurs only in the large diameter latch chamber. Accordingly, confronting faces 70, 71 of the main chamber members are brought into proximity of one another, but preferably, they always remain slightly spaced apart.

At this time, main housing 49 connector sub 50 contacts nut 52, thereby forcing main shaft 43 downhole which compresses each spring associated with the three spring chambers 146, 147, 155 and latches members 60, 62 together.

During this movement, the male latch part 60 is telescopingly received within the resilient fingers 62 of the female member of the latch device 61 as the female part 62 encapsulates the downwardly moving male part 60 of the latch device 61, 61. Simultaneously with this action, energy is stored within the three spring chambers.

In addition to the ability to preload the various springs by addition of spacers and the like, the adjustment means 44 near the upper end of the main shaft as well as the other adjustment means 52 located within chamber 53 between sub 50 and internal slidable connector 51 are adjusted to control the required tension in the E-line for triggering the release of latch 60, 61. It should be noted that the uphole enlarged terminal end of main shaft 43 is always spaced from anchor and seal means 42 as shown to prevent impact therebetween. Further, nut 44, when torqued one turn 360 degrees against spring device 46, preloads both the first and second spring devices with the equivalent of 50 pounds wireline tension, and consequently places an uphole force on male member 60 of the releasable latch device, thereby providing a means by which the tension in the E-line for releasing the latch device can be selected in the field.

When adjusting nut 52 is moved along threaded surface 53', the length of the jarring stroke is changed, while at the same time should the adjusting nut 52 be torqued against the downhole face of sub 50, this action will force male part 60 further into female part 61 of the latch device while pre-compressing the springs in all three stored energy chambers. Further, it should be noted that latch device 60, 61 can always be set into the latched position so long as the parts are properly spaced out to provide for the before mentioned adjustment.

In one embodiment of the invention, for example, the adjusting nut 44 increased the line tension 50# for each full rotation of the nut.

I claim:

1. An improved jar tool for delivering tools, including electronic packages, into wellbores and for retrieving tools stuck in the wellbore, comprising:

said jar tool includes upper and lower spaced housings having confronting spaced ends coupled together by a lost motion coupling for limited movement of the housings toward and away from one another along a common axis, and opposed ends opposed to one another and to the lost motion coupling; a closure member forming attachment means at each opposed end of the upper and the lower housings, respectively, for supporting and running the jar tool into and out of a wellbore and for attaching tools thereto; and confronting closure members at the confronting ends of the housings;

shaft having opposed ends reciprocatingly received respective the upper housing; said upper housing having axially aligned annular stored energy chambers formed respective said shaft and said housing; biasing means supported within each annular stored energy chambers, including springs having different spring characteristics;

transfer members extending from said shaft for engaging and compressing said biasing means to thereby store energy therewithin responsive to relative movement of said shaft respective said upper housing;

a releasable latch means interconnecting the shaft and lost motion coupling and for releasing the shaft respective the lost motion coupling upon demand after storing energy within the biasing means, thereby enabling acceleration of the upper housing away from the lower housing; a hammer and anvil, respectively, positioned within the upper housing on a confronting closure member and on the lost motion coupling, respectively;

an axial passageway formed through said upper housing, and continues on through the lost motion coupling into the lower housing, a protective tubing having ends with one end affixed respective the upper housing and the other end terminating within a chamber formed in the lower housing; said tubing is slidably received within the passageway, an electrical conductor extending through the tubing and having an end adapted to be connected to a conductor extending uphole from the upper housing, and another end being received within the chamber formed within the lower housing where the conductor is provided with a surplus length to provide for the length of the stroke occasioned by reciprocation of the upper housing respective the lower housing, the last said end of the conductor terminating in a connector adapted to be connected to apparatus supported respective said lower housing.

2. The jar tool of claim 1 wherein a wireline supports a sinker bar which is supportingly attached to the upper housing for running the jar tool into and out of the wellbore, and for moving the latch member from a latched into an unlatched position; and vice versa, said protective tubing extends through the shaft, through the releasable coupling, hammer, and lost motion coupling, where the lower terminal end of the tubing opens into the chamber formed in the lower housing where the conductor is provided with sufficient length to provide for the take up required by the length of the stroke occasioned by reciprocation of the main upper housing respective the lower main housing, the other end of the conductor is adapted to be connected to apparatus supported respective said lower chamber to thereby enable electronic data to be transmitted from the lower end of the jar tool axially through the jar tool, and along the wireline to the surface.

3. An improved jar tool for use in wellbores and for retrieving stuck objects from a wellbore, comprising:

upper and lower housings having confronting ends coupled together by a lost motion coupling for limited movement toward and away from one another along a common axis; and opposed ends opposed to one another and to said lost motion coupling; attachment means connected at each opposed end of the upper and the lower housings for supporting and running the tool into and out of the wellbore and for attaching an apparatus including a tool to the lower end of the lower housing;

a shaft having opposed ends reciprocatingly received within said upper housing; said upper housing having a plurality of annular stored energy chambers formed therein between said shaft and said upper housing; biasing means, including springs having different spring characteristics, are supported within the stored energy chambers and arranged concentrically respective said shaft;

said shaft having an outwardly extending member thereon connected to engage said biasing means for storing energy therein in response to relative movement of said upper housing respective said lower housing;

releasable latch means interconnecting one end of the shaft respective one end of the lost motion coupling for releasing energy stored within said biasing means upon demand; a hammer having opposed ends and forming a closure for said lower end of said upper chamber; an anvil affixed to and underlying the releasable latch means and confronting said hammer; said lost motion coupling interconnecting the upper and lower housings to be moved along a common axis toward and away from one another, and extends from the releasable latch means;

one end of the lost motion coupling terminates within said upper chamber while the other end is affixed to said lower housing; the anvil is positioned to transmit a jarring action through the lost motion coupling into the lower housing when said hammer impacts thereagainst;

said lower housing has a chamber formed therein; a piston slidably received within the chamber dividing the chamber into first and second chambers, said protective tubing extends through said first chamber, said piston; and into said second chamber where the conductor emerges from the tubing and is provided with a greater length than the length of the stroke of the lost motion coupling.

4. The improvement of claim 3 wherein the jar tool is run into a borehole supported by a wireline, said releasable latch means interconnects the shaft respective the lost motion coupling apparatus for releasing the lower end of the shaft from the lost motion coupling upon increase in the wireline tension;

a hammer formed on an inner face of the confronting closure member and an anvil connected to the shaft for abutting engagement of the hammer when said latch means is unlatched.

5. An improved jar tool for use in wellbores and for retrieving stuck objects from a wellbore, comprising:

said jar tool having axially aligned upper and lower housings having confronting ends and opposed ends; said housings being coupled together by a lost motion coupling arranged therebetween for limited movement of the housings toward and away from one another along a common axis;

a shaft having opposed ends and reciprocatingly received within said upper housing, and a plurality of annular stored energy chambers formed therein between said shaft and said housing; biasing means, including springs having different spring characteristics, are supported within said annular stored energy chambers and arranged concentrically respective said shaft;

a closure means connected at each opposed end of the upper and the lower housings for supporting and running the tool into and out of the wellbore and for attaching an apparatus, including a tool to the lower end of said lower housing; said lost motion coupling having one end attached to the confronting closure means of the lower housing, with the opposed end slidably extending through the confronting closure means of the upper housing where the lost motion coupling is attached to the shaft by a releasable latch means;

said shaft having an outwardly extending member thereon connected to engage said biasing means for storing energy therein in response to relative movement of said upper housing respective said lower housing;

a hammer formed on an interior face of the confronting closure means of the upper housing; an anvil affixed to and underlying the releasable latch means and confronting the hammer;

whereby; when the jar tool is in the latched configuration and subjected to an increased uphole force, the releasable latch means separates, releasing the shaft of the upper housing, whereupon the upper housing accelerates axially away from said lower housing and is arrested by said hammer abuttingly engaging said anvil, thereby providing a jar action for a tool string; wherein there is an axial passageway formed through said shaft, through said latch means, anvil, lost motion coupling and into a chamber formed in said lower chamber;

an electrical conductor within the passageway having opposed ends, one end adapted to be connected to a conductor extending uphole to the surface, the other end extending through the axial passageway into a chamber formed in the lower chamber where a conductor length is stored which is a greater length than the length of the stroke of the lost motion coupling.

6. The jar tool of claim 5 wherein there is an axial passageway formed through said upper housing, including extending through the shaft, releasable latch means, anvil, hammer, lost motion coupling, and opens into a chamber formed within the lower housing; a protective tubing attached respective the upper housing and slidably received within the passageway;

an electrical conductor supported within the protective tubing and having opposed ends, one conductor end adapted to be connected to a conductor extending uphole toward the surface, the other end extending into a chamber formed within the lower housing, said housing being divided into chambers by a movable wall through which the end of the tubing extends, and where the conductor is stored in a loose or serpentine configuration where the terminal end can be connected to an apparatus supported by the lower housing.

7. Method for electronically communicating between an uphole apparatus and a downhole jar tool apparatus that forms part of a tool string located downhole within a wellbore, and, wherein the jar tool is useful for retrieving stuck objects from a wellbore;

said jar tool includes opposed upper and lower housings having confronting ends coupled together by a lost motion coupling having one end affixed to the lower housing and the other end extending into the upper housing where it is connected to a releasable latch apparatus interposed between the shaft and the lost motion coupling for limited movement of the housings toward and away from one another along a common axis; and, opposed ends opposed to one another and to said lost motion coupling, with there being attachment means at each opposed end of the upper and the lower main housings for supporting and running the tool into and out of a borehole and for attaching an apparatus, including a tool, to the lower end thereof;

there being axially aligned annular stored energy chambers formed within said upper main housing; and, biasing means, including springs, within each stored energy annular chamber arranged concentrically respective the shaft which is connected to the shaft in a manner to store energy within said biasing means responsive to relative movement between said upper and lower housings; comprising the steps of:

step 1. configuring the shaft to engage the biasing means to compress the biasing means and thereby store energy therein responsive to downward movement of said upper housing respective the lower housing;

step 2: forming a hammer and anvil, respectively, within the upper chamber with the hammer being formed on the interior face of the confronting closure member and the anvil being formed on the lost motion coupling underlying the releasable latch means;

step 3: forming an axial passageway extending from the upper closure member of the upper housing and through the shaft, biasing means, releasable latch means, anvil, hammer, lost motion coupling, and into a chamber formed within the lower housing;

step 4. placing a hammer on a closure member for closing the lower end of said upper main chamber and extending the hammer into said upper main chamber concurrently with applying the closure member to the lower end of the upper chamber;

step 5. mounting an anvil respective said main shaft for decelerating the hammer in response to release of energy from said biasing means;

step 6. forming an axial passageway through said shaft that extends through said latch means, anvil, lost motion coupling, and into the chamber of the lower housing; and extending a conductor through the passageway with the conductor having ends, one end adapted to be connected to a tool attached at the lower end of the lower housing wherein the last said end is provided with a surplus length to provide for the length of the stroke occasioned by the reciprocation of the upper housing respective the lower housing; and further including the step of protecting the conductor by the provision of a protective tubing through which the conductor extends, wherein the tubing is slidably received within the passageway with one end of the tubing being affixed to the upper housing closure member and the other end of the tubing opening into the chamber of the lower housing.

8. The method of claim 7 and further including the step of protecting the conductor by the provision of a protective tubing through which the conductor extends; a piston slidably received within the chamber dividing the chamber into first and second chambers, said protective tubing extends through said first chamber, said piston; and into said second chamber where the conductor emerges from the tubing and is provided with a greater length than the length of the stroke of the lost motion coupling.

* * * * *